US006471733B1

(12) United States Patent
Cooper

(10) Patent No.: US 6,471,733 B1
(45) Date of Patent: Oct. 29, 2002

(54) POLISHING WHEEL

(76) Inventor: Alex Cooper, 30-96 Brighton 6th St., Brooklyn, NY (US) 11235

( * ) Notice: Subject to any disclaimer, the term of this patent is extended or adjusted under 35 U.S.C. 154(b) by 17 days.

(21) Appl. No.: 09/669,593

(22) Filed: Sep. 26, 2000

(51) Int. Cl.[7] ..... B24D 3/00; B24D 11/00; B24D 17/00

(52) U.S. Cl. ..... 51/298; 51/295; 51/297; 51/307; 51/309

(58) Field of Search ..... 51/295, 298, 297, 51/307, 309; 451/540, 526, 533, 539

(56) References Cited

U.S. PATENT DOCUMENTS 3,750,348 A * 8/1973 Johnson ..... 451/523
3,906,684 A * 9/1975 Marshall et al. ..... 51/298
4,539,017 A * 9/1985 Augustin ..... 51/295
4,629,473 A * 12/1986 Ruid et al. ..... 51/298
5,221,293 A * 6/1993 Ferlemann et al. ..... 51/298
5,702,800 A * 12/1997 Mihayashi et al. ..... 51/295
6,120,365 A * 9/2000 Johnson ..... 451/523

* cited by examiner

*Primary Examiner*—Michael Marcheschi
(74) *Attorney, Agent, or Firm*—I. Zborovsky

(57) ABSTRACT

A polishing tool which has a working layer with abrasive particles composed of cerium dioxide and a synthetic resin binder, a body layer, and an intermediate layer located between the working layer and the body layer, wherein the body layer is harder than the working layer, and the intermediate layer is softer than the working layer.

6 Claims, 2 Drawing Sheets

POLISHING WHEEL

BACKGROUND OF THE INVENTION

The present invention relates generally to polishing tools.

More particularly it relates to tools for finish polishing of bevel and flat edges of technical glass on multi-spindle grinding-polishing machines, such as for example "Bovone" "Zenneti", Bavelloni", etc.

In polishing operations on the above mentioned machines, well known felts wheels with a dimensions "D150 mm×D70 MM×25 MM are utilized with cerium dioxide slurry. The polishing wheels rotate with a linear speed about 10 M/sec and a longitudinal speed of glass about 1.0–3.0 m/min, depending on the glass thickness. The polishing wheel and the glass surface contact each other with a pressure of 4–6 bars. Cerium dioxide powder ratio in water varies from 50–100 grams per liter, and circulates through 250–500 liter tanks.

The polishing method which includes the use of the above mentioned felt wheels with a cerium dioxide slurry has substantial disadvantages. Great amounts of powders cause environmental disposal problems. The slurries have pH value about 7 and has to be checked twice a day, because this value increases to 8–8.2 pH and as a result reduces the cerium efficiency. It is necessary to add sulphuric acid to the tank to mixture to provide the right pH value. The user cerium dioxide slurry causes incrustation of the base of a back conveyor which creates irregular surface for glass passage, and correspondingly waved flats, and glass breaking and irregularity of the polishing process. Difficulties in mixing of powders with water cause a non uniformity of the slurry, which can compromise the polishing process, create technical problems, and raise adjustment costs. Also, the incrustations are highly damaging for the machine and seriously compromise the production. The use of slurry and sulphur acid cause deterioration of the machines which reduces a lifetime of the machines and requires expensive repairs. Polishing felt wheels have short service life and can polish about 10,000–15,000 linear inches, depending on the glass thickness.

U.S. Pat. No. 6,033,449 discloses a polishing tool for the above-mentioned processes, which includes cerium dioxide as abrasive, in a corresponding binder. The use of the polishing tool eliminates the above mentioned disadvantages of the polishing process with felt wheels and cerium dioxide slurry. In a polishing process of glass on multi-spindle machine with the tool in accordance with this patent and with technological parameters specified herein above, the use of the wheel with 60–90 shore hardness in a contact zone of the glass with the wheel can cause rapid raise of temperature to about 180–200° C. and occurrence of local damaged spaces on the polishing layer of the tool, which creates "whiting" at polishing surfaces of glass. This reduces the quality of polishing. Also, the working layer of the tool must be dressed to take off glazed parts of the polishing tool. It is believed to be clear that it is advisable to eliminate the above mentioned disadvantages.

SUMMARY OF THE INVENTION

Accordingly, it is an object of the present invention to provide a polishing wheel, which avoids the disadvantages of the prior art.

In keeping with these objects and with others which will become apparent hereinafter, one feature of present invention resides, briefly stated, in a polishing tool which has a working layer with abrasive particles composed of cerium dioxide and a synthetic resin binder, a body layer, and an intermediate layer located between the working layer and the body layer, wherein the body layer is harder than the working layer, and the intermediate layer is softer than the working layer.

It is advantageous when the ratio hardness between the working layer and the intermediate layer is 4:1.

When the polishing wheel is designed in accordance with the present invention, it eliminates the disadvantages of the prior art. In particular, local vibrations of the polishing wheel are absorbed, a full contact is achieved between the working layer of the polishing tool and a surface of glass to be polished during the polishing process. The polishing wheel has a high wear resistance and a long service life, and provides an efficient polishing, such that each millimeter of thickness of the working layer can polish about 40,000 linear inches of glass.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 3:
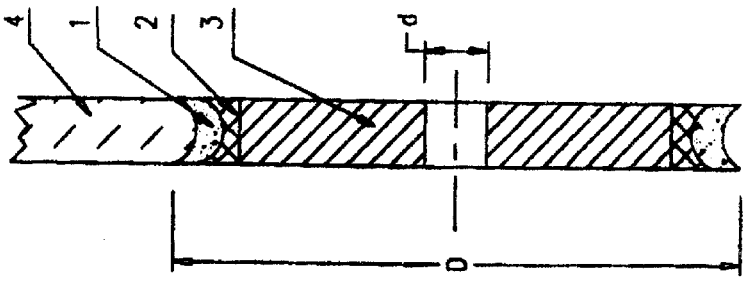
FIG. 3 is a view showing an inventive polishing wheel in accordance with still another embodiment of the present invention.

A polishing wheel in accordance with the present invention has a working layer which is identified as a whole with reference numeral 1. It further has a body layer which is identified as a whole with reference numeral 3, as well an intermediate layer 2 located between the working layer 1 and the body layer 3. The working layer 1 includes abrasive particles of cerium dioxide in a synthetic resin binder.

In accordance with the new features of present invention, the intermediate layer 2 is substantially softer than the working layer 1. In particular, the hardness of the intermediate layer 2 is four-three times lower than the hardness of the working layer 1. For example, the working layer 1 can have Shore scale hardness of 34–45 while the intermediate layer 2 has a Shore scale hardness 8–15. The body layer 3 can have a Shore scale hardness 45–60. With the polishing wheel designed in accordance with the present invention, local vibrations are absorbed, full contact of all parts of surface of glass 4 to be polished by the wheel is obtained in the process of polishing, and at the same time the polishing wheel has high wear resistance, long surface life, high efficiency of material removal.

In the working layer the concentration of cerium dioxide can be no less than 85%, for example between 87 and 96 percent by weight. The binder can be a high molecular binder which includes a high molecular hydrogenated nitrile elastomer with a vulcanization temperature not less than 170° C. It can include synthetic rubber, and materials for vulcanization, solidification, softening, plasticization and stabilization. The hydrogenated nitrile elastomer can be for example nitrile butediene rubber. The composition of a working layer, in part by weight, can be for example as follows:

| | |
|---|---|
| Hydrogenated Nitrile Elastomer | 100 |
| 85–90% concentrated Cerium Dioxide polishing powders | 800–2500 |
| Polyvinilchloride | 2.5–30 |
| Phenol resin (fore xample DUREZ 12687) | 2.5–14 |
| Dibutilphtalate (optional) | 5–80 |
| Ammonium chloride | 1–2 |
| Sulfur | 1.5–25.0 |

The cerium dioxide polishing powder can be powder for example "UENCER" 65, or CEREX 1650. The phenol resin can be for example "DUREZ" 12687.

The hydrogenated nitrile elastomer can be for example ZETPOL 20301.

The intermediate layer 2 is chemically connected with the working layer 1 and provides force and vibration absorption properties for the polishing wheel during the polishing process. It also is composed of hydrogenated nitrile elastomer and substances for vulcanization, solidification, plastification, softening, stabilization, etc. The composition of the intermediate layer in part by weight can be as follows:

| | |
|---|---|
| Hydrogenated Nitrile Elastomer | 100 |
| Vinyl Chloride | 10–30 |
| Magnesium Oxide | 4–15 |
| Zinc Oxide | 4–15 |
| Dibutilphtalate | 5–20 |
| Sulfur | 1.5–4 |

The body layer 3 is chemically connected to the intermediate layer 2 and is attachable to a spindle of the corresponding machine. It also is composed of hydrogenated nitrile elastomer with the additives. Its composition in part by weight, can be as follows:

| | |
|---|---|
| Hydrogenated Nitrile Elastomer | 100 |
| Phenol Resin | 50–80 |
| Calcium Bicarbonates | 4–6 |
| Thimetitltiurate | 0.4–0.7 |
| Altax | 2–4 |
| Sulfur | 30–40 |

The polishing wheel in accordance with the present invention is produced in the following manner. First of all each of the above mentioned three layers 1, 2, 3 is produced. For this purpose the composition for the corresponding layer is prepared, the mixture of the composition is rolled on a calander roll stand, the three-ring shaped elements are cut from the thusly produced rolled sheets, placed over one another and treated in a hot plate press so that the ring-shaped elements vulcanized and co-vulcanized to one another.

It is preferable, in accordance with the present invention, that the intermediate layer 2 is thicker than the working layer 1. The ratio of the thickness of the intermediate layer 2 to the working layer 1 can be for example 0.8–4.0:1.

Figure 1:
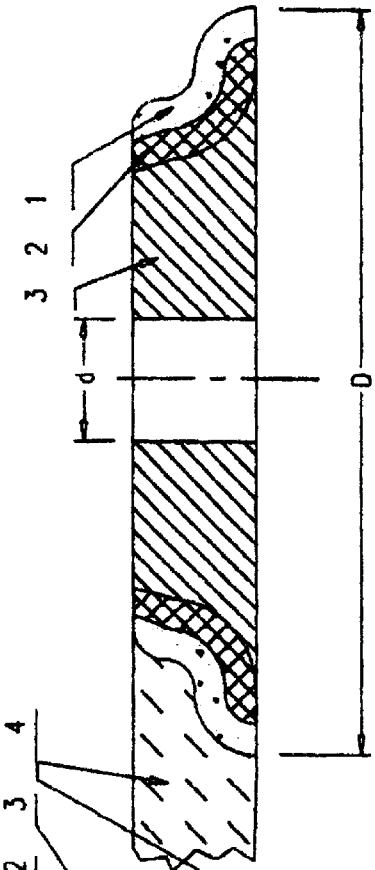
FIG. 1 is a cross-section of a polishing wheel in accordance with one embodiment of the present invention.

FIG. 1 shows the polishing tool in accordance with the present invention which is formed as a substantially flat disk. It can be used for polishing of a flat edge of an industrial glass, as well as for polishing of bevels on the edges of the industrial glass.

Figure 2:
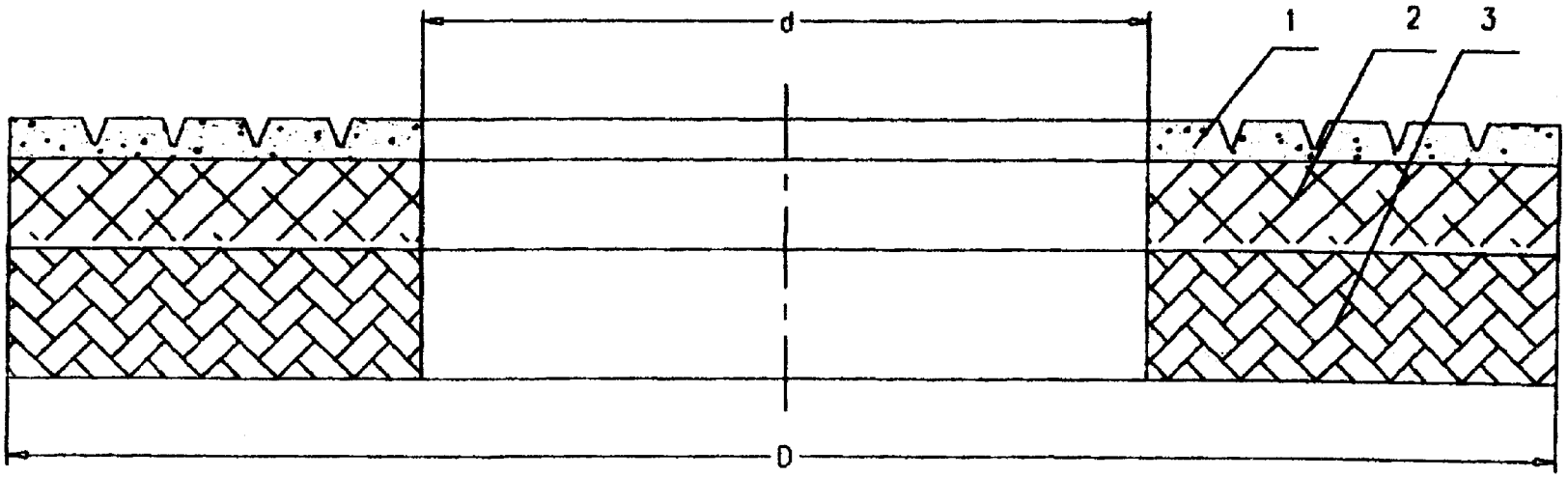
FIG. 2 is a cross-section of the inventive polishing wheel in accordance with another embodiment of present invention.

The polishing wheel shown in FIG. 2 is utilized for polishing of shaped edges of industrial glass. For this purpose the outer surface of the working layer 1 has a convex and a concave portion merging into one another. The ratio of the hardness between the working layer 1 and the intermediate layer 2 is the same as in the tool shown in FIG. 1. The ratio of the thicknesses of the working layer 1 and the intermediate layer 2 is also the same as in the tool shown in FIG. 1, while in different areas of the intermediate layer the ratio can be different.

The polishing wheel shown in FIG. 3 also has the same layers 1, 2, 3. However, the outer surface of the working layer 1 is concave, so that the tool can be used for polishing of convex, radiused edges of the industrial glass. The tool has the same hardness ratio and thickness ratio between the working layer 1 and the intermediate layer 2 as in the preceding tools.

Figure 4:
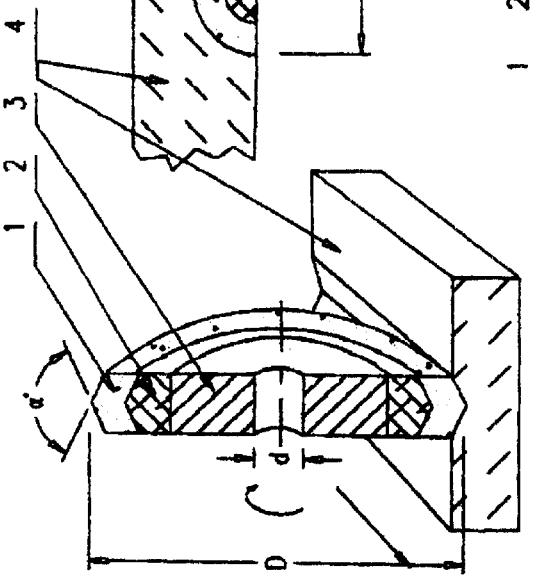
FIG. 4 is a view showing the polishing wheel in accordance with a further embodiment of present invention.

The polishing wheel shown in FIG. 4 is used for polishing of V-grooves on the flat industrial glass. It also has the layers 1, 2, 3 with the same ratio of their hardness and thicknesses. The shape of the outer surface of the working layer 1 is however pointed, so as to engage into a V-shaped groove of the glass.

Figure 5:
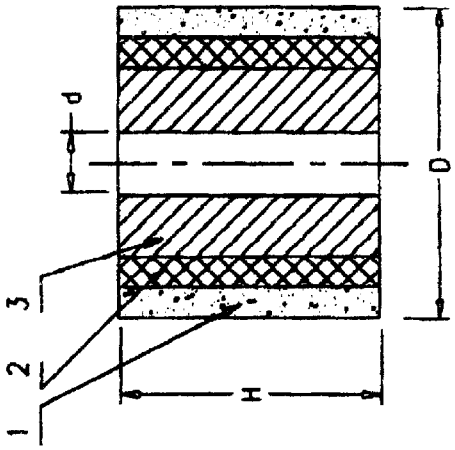
FIG. 5 is a view showing the polishing wheel in accordance with an additional embodiment of the inventive embodiment.

Finally the polishing wheel shown in FIG. 5 can be used for polishing of inner cylindrical surfaces and outer cylindrical surfaces. It also has the layers 1, 2, 3 with the same hardness ratio and thickness ratio of the working layer 1 and the intermediate layer 2 as in the previous tools. However, to surface of the working layer is cylindrical.

A very important feature of the present invention is that, in contrast to the tool disclosed in U.S. Pat. No. 6,033,449, the content of phenol resin is 2.5–14 weight parts, which substantially is lower than in the prior art tool. As a result, the working layer is softer, so that during polishing it better follows the shape of a surface to be polished, provides a higher quality of polishing, releases easier the grains of cerium dioxide to perform material removal.

In accordance with a further embodiment of the present invention, the working layer includes grains of industrial diamond, with the size of 1–10 microns and concentration 0.1–12 volume percent from the volume of the working layer. The industrial diamond powder serves as a mechanical promoter which improves the polishing process.

It will be understood that each of the elements described above, or two or more together, may also find a useful application in other types of constructions differing from the types described above.

While the invention has been illustrated and described as embodied in polishing wheel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A polishing tool, comprising a working layer with comprises cerium dioxide abrasive particles and a synthetic resin binder, a body layer, and an intermediate layer located between the working layer and the body layer, wherein the body layer is harder than the working layer, and the intermediate layer is softer than the working layer, said intermediate layer having a hardness which is 3 to 4 times lower than a hardness of said working layer, said intermediate layer having a thickness which is 0.8 to 4 times a thickness of the working layer.

2. A polishing tool as defined in claim 1, wherein said working layer has the following composition consisting of, in part by weight

| | |
|---|---|
| Hydrogenated Nitrile Elastomer | 100 |
| 85–90% concentrated Cerium Dioxide polishing powders | 800–2500 |
| Polyvinilchloride | 2.5–30 |
| Phenol resin (fore xample DUREZ 12687) | 2.5–14 |
| Dibutilphtalate (optional) | 5–80 |
| Ammonium chloride | 1–2 |
| Sulfur | 1.5–25.0. |

3. A polishing tool as defined in claim 1, wherein said binder includes 2.5–14 weight part of phenol resin.

4. A polishing tool as defined in claim 1, wherein said working layer also includes grains of diamonds.

5. A polishing tool, comprising a working layer with comprises cerium dioxide abrasive particles and a synthetic resin binder, a body layer, and an intermediate layer located between the working layer and the body layer, wherein the body layer is harder than the working layer, and the intermediate layer is softer than the working layer, said intermediate layer having the following composition consisting of in part by weight:

| | |
|---|---|
| Hydrogenated Nitrile Elastomer | 100 |
| Vinyl Chloride | 10–30 |
| Magnesium Oxide | 4–15 |
| Zinc Oxide | 4–15 |
| Dibutilphtalate | 5–20 |
| Sulfur | 1.5–4. |

6. A polishing tool, comprising a working layer with comprises cerium dioxide abrasive particles and a synthetic resin binder, a body layer, and an intermediate layer located between the working layer and the body layer, wherein the body layer is harder than the working layer, and the intermediate layer is softer than the working layer, said working layer, said intermediate layer, and said body layer all include hydrogenated nitrile elastomer and being chemically connected with one another.

* * * * *